US010562093B2

(12) United States Patent
Bohli et al.

(10) Patent No.: US 10,562,093 B2
(45) Date of Patent: Feb. 18, 2020

(54) SUPPLY SYSTEM FOR SUPPLYING A MOULD WITH MOLTEN METAL, AND FACILITY AND MANUFACTURING METHOD IMPLEMENTING SAME

(71) Applicants: SAFRAN, Paris (FR); SAFRAN AIRCRAFT ENGINES, Paris (FR)

(72) Inventors: Ramzi Bohli, Moissy-Cramayel (FR); Ngadia Taha Niane, Moissy-Cramayel (FR); David Grange, Moissy-Cramayel (FR); Didier Maurice Marceau Guerche, Moissy-Cramayel (FR); Saïd Boukerma, Moissy-Cramayel (FR)

(73) Assignees: SAFRAN, Paris (FR); SAFRAN AIRCRAFT ENGINES, Paris (FR)

( * ) Notice: Subject to any disclaimer, the term of this patent is extended or adjusted under 35 U.S.C. 154(b) by 0 days.

(21) Appl. No.: 16/099,100

(22) PCT Filed: May 10, 2017

(86) PCT No.: PCT/FR2017/051116

§ 371 (c)(1),
(2) Date: Nov. 5, 2018

(87) PCT Pub. No.: WO2017/194879

PCT Pub. Date: Nov. 16, 2017

(65) Prior Publication Data

US 2019/0184451 A1 Jun. 20, 2019

(30) Foreign Application Priority Data

May 11, 2016 (FR) ..... 16 54202

(51) Int. Cl.
*B22C 9/08* (2006.01)
*B22C 9/04* (2006.01)
(Continued)

(52) U.S. Cl.
CPC ..... *B22C 9/082* (2013.01); *B22C 9/04* (2013.01); *B22C 9/12* (2013.01); *B22C 9/22* (2013.01); *B22D 27/045* (2013.01); *B22D 35/04* (2013.01)

(58) Field of Classification Search
CPC .. B22C 9/04; B22C 9/08; B22C 9/082; B22C 9/12; B22C 9/22; B22D 27/04; B22D 27/045; B22D 35/04
(Continued)

(56) References Cited

U.S. PATENT DOCUMENTS 5,244,187 A * 9/1993 Manginelli ..... B22D 35/04 164/129
7,231,955 B1 6/2007 Bullied et al.
(Continued)

FOREIGN PATENT DOCUMENTS

CN 105290333 A 2/2016
EP 2 233 229 A1 9/2010
EP 2 965 838 A1 1/2016

OTHER PUBLICATIONS

International Search Report as issued in International Patent Application No. PCT/FR2017/051116, dated Nov. 20, 2017.
(Continued)

*Primary Examiner* — Kevin P Kerns
(74) *Attorney, Agent, or Firm* — Pillsbury Winthrop Shaw Pittman LLP

(57) ABSTRACT

A feed system for conveying a molten metal that is to make a casting, the system including a feed channel made of ceramic material that is configured to enable the molten metal to flow by gravity inside the feed channel, the feed channel having a first portion extending in a first direction, and at least one second portion extending in a second direction different from the first direction, the second portion being arranged downstream from the first portion and being connected to the first portion by a junction. The system further includes a damping channel having a first end opening out into the junction and a second end that is closed, the damping channel extending the first portion of the feed channel.

10 Claims, 4 Drawing Sheets

(51) Int. Cl.

| | |
|---|---|
| ***B22C 9/22*** | (2006.01) |
| ***B22D 27/04*** | (2006.01) |
| ***B22D 35/04*** | (2006.01) |
| ***B22C 9/12*** | (2006.01) |

(58) Field of Classification Search
USPC ..... 164/133, 335, 122.1, 162
See application file for complete search history.

(56) References Cited

U.S. PATENT DOCUMENTS 7,918,265 B2 * 4/2011 Verner et al. ..... B22C 7/02
164/122.2
9,687,910 B2 * 6/2017 Bullied et al. ..... B22D 19/16

OTHER PUBLICATIONS

International Preliminary Report on Patentability and the Written Opinion of the International Searching Authority as issued in International Patent Application No. PCT/FR2017/051116, dated Nov. 13, 2018.

* cited by examiner

SUPPLY SYSTEM FOR SUPPLYING A MOULD WITH MOLTEN METAL, AND FACILITY AND MANUFACTURING METHOD IMPLEMENTING SAME

CROSS REFERENCE TO RELATED APPLICATIONS

This application is the U.S. National Stage of PCT/FR2017/051116 filed May 10, 2017, which in turn claims priority to French Application No. 1654202, filed May 11, 2016. The contents of both applications are incorporated herein by reference in their entirety.

BACKGROUND OF THE INVENTION

The invention relates to the general field of fabricating parts by casting. The invention relates more particularly, but not exclusively, to a feed system for feeding a mold with molten metal in order to fabricate parts by lost wax casting, in particular in a gravity bottom casting configuration.

In known manner, in a lost wax casting method, a wax model of the part to be fabricated is made initially and then a ceramic shell is formed around it so as to form a mold. A molten metal is then cast into the mold, and it is possible to implement directed solidification of the metal in order to obtain the casting after removing the mold. This method is advantageous for fabricating metal parts of complex shape, and it also makes possible to obtain parts that are of monocrystalline structure, e.g. by using a seed or a grain selector duct.

When the liquid metal fills the mold from below solely under the effect of gravity, this is referred to as gravity "bottom casting". Under such circumstances, a feed system is generally provided for feeding the mold with molten metal from a bush that is situated higher than the mold, and the mold can be filled progressively upwards from the bottom. With bottom casting, the speed of the liquid metal front entering into the mold for the first time at the beginning of casting (also referred to as the first "metal stream") can be high. In certain circumstances, this speed may be as much as 1.5 meters per second (m/s). This phenomenon can lead to leaks, to inclusions in the mold of particles torn from the ceramic shell, and, sometimes to degradation or shifting of a core present in the mold.

Feed systems are known that comprise a feed duct for conveying the molten metal into the mold, the duct being provided with a bend where it turns sufficiently to reduce the speed of the first metal stream before it reaches the mold, e.g. by turning through 90°. Although such feed systems serve to reduce the speed of the first stream, they lead to new problems at the bend. Specifically, when the first metal stream reaches the bend at a high speed, it strikes against it, thereby leading to extra pressure that can be referred to as a pressure surge. This phenomenon can lead to ceramic particles being torn away at the bend, and can weaken the feed system, which can then suffer from leaks of molten metal.

There therefore exists a need to have a feed system available for conveying molten metal into a mold, but that does not present the above-mentioned drawbacks.

OBJECT AND SUMMARY OF THE INVENTION

A main object of the present invention is thus to mitigate such drawbacks by proposing an installation made of ceramic material for fabricating a plurality of castings from a molten metal, the installation comprising:

a vertical duct surmounted by a bush through which a liquid metal is to be introduced into the installation, the vertical duct including a distributor in the proximity of its bottom end;

at least one feed system for conveying the molten metal for making the castings, each feed system comprising a feed channel configured to enable the molten metal to flow under gravity inside said feed channel, said feed channel having a first portion extending in a first direction from the distributor, and two second portions extending in a second direction different from the first direction, each second portion being arranged downstream from the first portion and being connected to the first portion by a junction; and at least two molds, each mold being connected to a second portion of the feed channel so that a molten metal can be conveyed from the feed system into each mold.

The feed system further comprises a damping channel having a first end opening out into the junction and a second end that is closed, said damping channel extending the first portion of the feed channel.

The installation including a feed system of the invention can be used for casting in a gravity bottom casting configuration. Specifically, the feed channel is configured to allow a molten metal to flow under gravity, e.g. by having an inclination that is sufficient to enable the metal subsequently to be conveyed to the inside of a mold, e.g. connected to the second portion of the feed channel. The mold may be fed from a bottom end so that the metal can fill it going upwards. The junction between the first and second portions of the feed channel serves to deflect the first metal stream between the two portions in order to slow it down before it reaches the mold.

The invention proposes a feed system that is remarkable in that it further comprises a damping channel that extends the first portion of the feed channel. The damping channel opens out at a first end into the junction in the feed channel, and it is blind (i.e. closed or obstructed) at a second end. Since the damping channel extends the first portion of the feed channel, the molten metal naturally begins by flowing into the first portion of the feed channel and then into the damping channel, which is filled, before finally flowing into the second portion of the feed channel in order subsequently to fill a mold.

It should be observed that the damping channel of the invention is empty before pouring in the metal, in other words that no element is present inside it, and in particular the damping channel does not have any seed (e.g. a monocrystalline seed). In particular, no metal is present inside the installation before the beginning of casting.

The damping channel of the system of the invention serves to subject the first metal stream to further damping when it reaches the junction. Specifically, the inventor has performed simulations that show that the speed of the first metal stream can be reduced to less than 0.4 meters per second (m/s) after the junction by using a feed system of the invention; whereas in an equivalent system merely having a 90° bend instead of the damping channel, the speed may be as much as 0.7 m/s. The damping channel thus makes it possible to reduce the pressure surge effect that takes place at the junction. The feed channel is weakened less, and the risk of ceramic particles becoming detached from the feed channel is reduced.

In addition, since the speed of arrival of the metal is reduced, a mold connected to the feed system of the invention is filled in more balanced manner. The risks of any core that might be present in the mold being shifted or broken are thus reduced.

Finally, when the first metal stream reaches the damping channel, at least a portion of it remains trapped inside the damping channel. It is this first metal stream that generally conveys ceramic impurities and oxides that are to be avoided within the casting. The damping channel thus serves to reduce the presence of such undesirable elements in the casting.

In an embodiment, the feed channel of the feed system may present a section that is circular, the length of the damping channel being equal to at least twice the diameter of the feed channel. This provision improves the trapping effect on the first metal stream.

In an embodiment, the damping channel may have a first portion extending between the first end and a second portion, said second portion extending between said first portion and said second end of the damping channel, said second portion being situated lower than said first portion. In this configuration, the second portion of the feed channel serves to increase the trapping effect on the first metal stream. Specifically, since the second portion is situated lower than the first portion, i.e. below it, the metal is constrained to remain in the damping channel by gravity. Preferably, the second portion of the damping channel extends in a direction different from the direction in which the first portion of the damping channel extends.

In an embodiment, the second portion of the damping channel may extend in a direction that is inclined.

In an embodiment, the second portion of the damping channel of the feed system may extend in a direction that is substantially vertical, so as to further increase the trapping of the first metal stream.

In an embodiment, the damping channel of the feed system may present a section that is semicircular.

In an embodiment, the first and second directions are mutually orthogonal. When the feed channel has only one second portion, the junction may for example be in the form of a bend with an angle of 90°. When the feed channel has two second portions, e.g. extending in the same direction, the junction may be in the form of a T-junction; the vertical bar of the feed corresponding to the first portion and the horizontal bar of the feed corresponding to the two second portions. This provision also serves to reduce the overall size of the system since it is integrated in an installation as described below.

In an embodiment, the second portion of the feed channel and the first portion of the damping channel lie in the same horizontal plane.

The installation may further comprise at least two grain selector ducts, each grain selector duct being connected both to a second portion of a feed channel and also to a mold. A grain selector duct serves in particular to obtain castings that, after directed solidification, present a structure that is monocrystalline.

The molds may be adapted to molding turbine blades of an aviation turbine engine.

Such an installation may be made out of ceramic from a wax model of said installation. The installation may then constitute a single ceramic element.

Finally, the invention provides a method of fabricating a plurality of castings from a molten metal, the method comprising the following steps:

filling molds with a molten metal by introducing a molten metal into the bush of an installation as described above; and implementing directed solidification of the metal present in each mold so as to obtain the casting.

BRIEF DESCRIPTION OF THE DRAWINGS

Other characteristics and advantages of the present invention appear from the following description made with reference to the accompanying drawings, which show embodiments having no limiting character. In the figures.

DETAILED DESCRIPTION OF THE INVENTION

The present invention is described below in its application to fabricating turbine blades for an aviation turbine engine by gravity lost wax casting. The present invention serves advantageously to reduce the inclusion of impurities in the casting due in particular to the metal penetrating into the mold feed system too suddenly, while also reducing the presence of oxides that can be transported by the first metal stream in the feed system.

Figure 1:
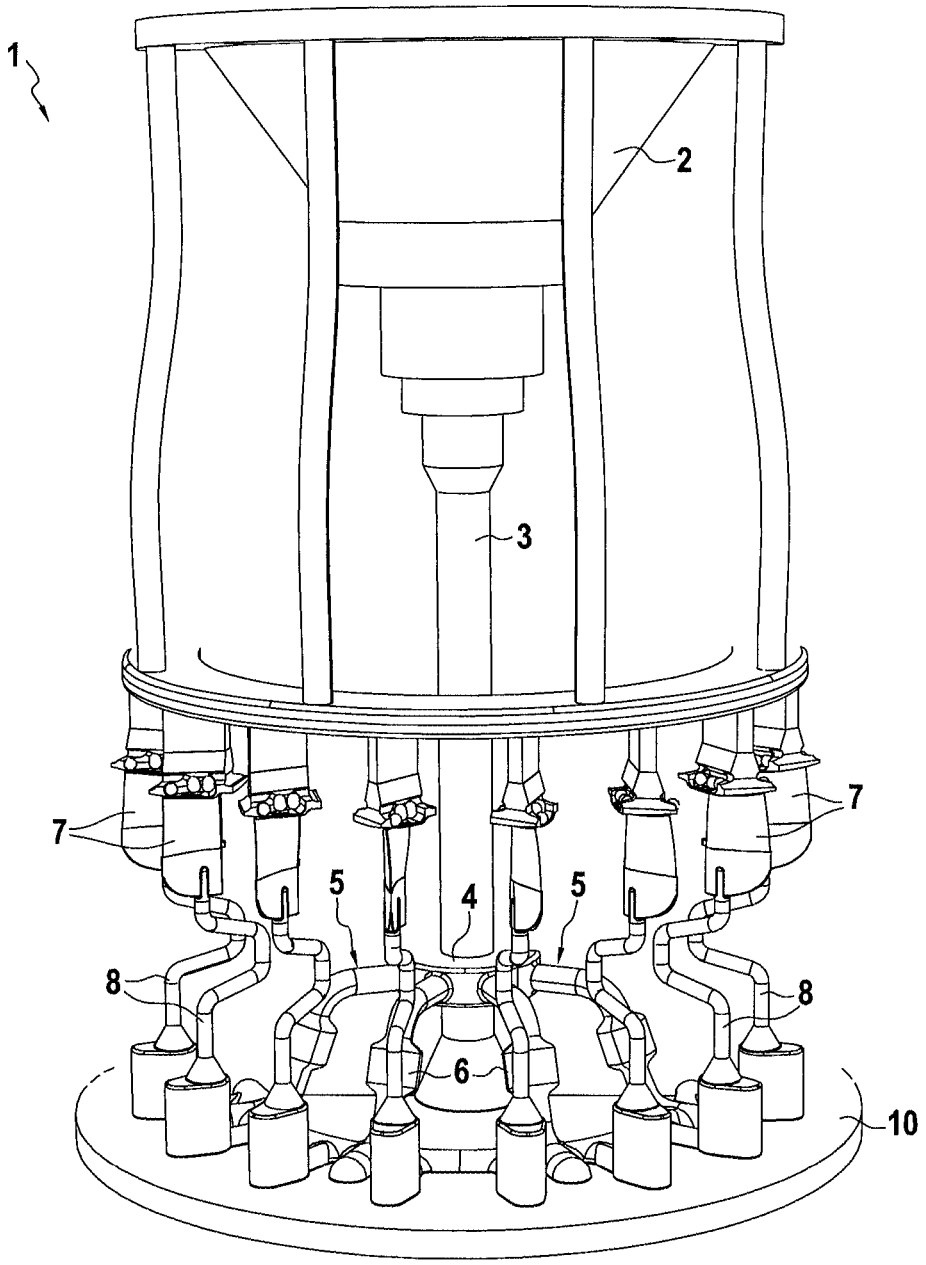
FIG. 1 shows an installation for fabricating a casting from a molten metal.

FIG. 1 shows an installation 1 of the invention for fabricating a casting from a molten metal by a gravity bottom casting type casting method. For greater clarity, FIG. 1 shows only a portion of an installation of the invention, the portion that is not shown being identical.

In the present disclosure, the terms "upstream" and "downstream" are defined relative to the flow direction of molten metal within the installation.

The installation 1 comprises firstly a bush 2 through which a liquid metal can be introduced into the installation 1. The bush 2 lies above a vertical central duct 3 that includes a distributor 4 close to its bottom end, which is plugged. The distributor 4 is annular in shape around the central duct 3 and serves to distribute the metal that is introduced into the installation 1 among a plurality of feed systems 5. Each feed system 5 may be provided with a filter 6 that serves to eliminate a portion of any impurities that might be present in the liquid metal entering into the feed system 5. Each feed system 5 is connected, by channels that are described below, to molds 7 via grain selector ducts 8. In known manner, the grain selector ducts 8 serve to obtain parts that are monocrystalline after directed solidification. In this example, the molds 7 are adapted to fabricate turbine blades for an aviation turbine engine, i.e. they have the shape of such blades. It should be observed that in this example the installation stands on a horizontal base plate 10 that serves to support the entire installation 1 throughout the fabrication method that is described below. The base plate 10 may be designed to seed the first metal grains.

From upstream to downstream, a liquid metal can travel through the following portions under the effect of gravity: the bush 2; the central duct 3; the distributor 4; a feed system 5; a grain selector duct 8; and a mold 7. The mold 7 is thus filled from the bottom upwards, the grain selector duct 8 being connected to the mold 7 via a bottom portion of the mold 7.

Figure 2A:
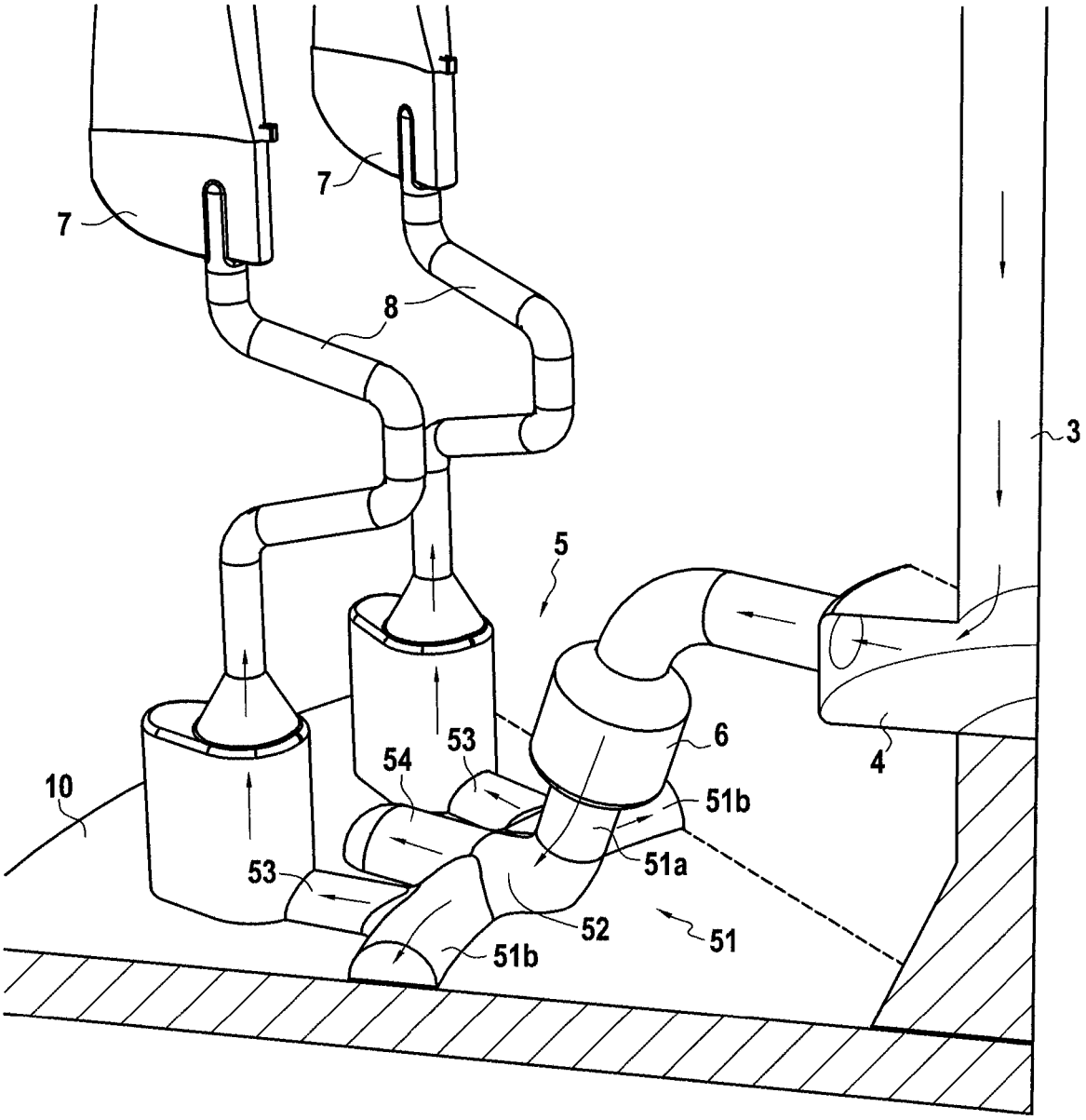
FIGS. 2A and 2B are views on a larger scale of the FIG. 1 installation showing a feed system.
Figure 2B:
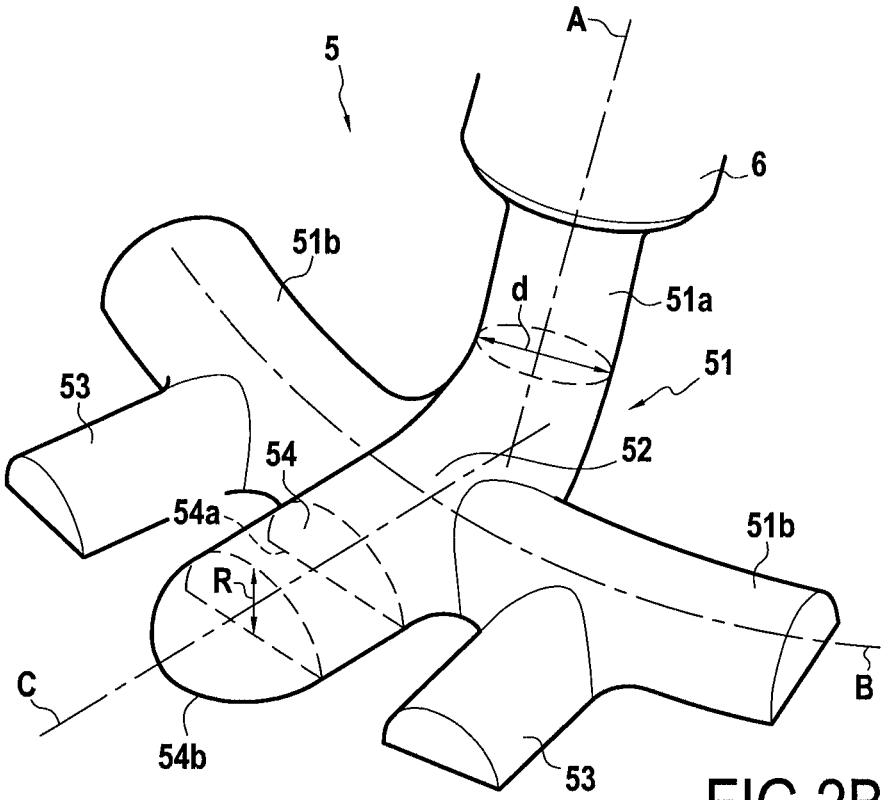

FIGS. 2A and 2B show a feed system 5 of the invention in greater detail. The feed system 5 comprises a feed channel 51 arranged so that molten metal can be conveyed by gravity along the channel 51. The feed channel 51 has a first portion 51*a* that extends from the distributor 4 to the level of the base plate 10 in a first direction A (FIG. 2B), which direction is inclined relative to the horizontal in this example. The first portion 51*a* of the feed channel 51 is of circular section in this example. In the example shown, the first portion 51*a* of the feed channel 51 is not vertical, i.e. it is at an angle other than 90° relative to the top surface of the base plate 10.

The feed channel 51 also has two second portions 51*b* that are connected to the downstream end of the first portion 51*a* at a junction 52. The two portions 51*b* extend in directions that are different from the first direction A of the first portion 51*a*. In the example shown, the second portion 51*b* extends on either side of the junction 52 in a second direction B that is circumferential around the central duct 3. At the junction 52, the feed channel 51 is thus in the form of a T, the vertical bar of the T corresponding to the first portion 51*a* and the horizontal bar corresponding to the two second portions 51*b* of the feed channel 51. Each second portion 51*b* of the feed channel 51 is then connected by a channel 53 to a grain selector duct 8. In the installation shown in this figure, each second portion 51*b* of the feed channel 51 is connected to a second portion 51*b* of a neighboring feed system 5 so that together the second portions 51*b* of the installation 1 form a circular duct on the base plate 10 around the central duct 3. In this example, the second portions 51*b* of the feed channel 51 present a section that is semicircular. In a variant that is not shown, each second portion 51*b* of the feed channel need not be connected to a second portion 51*b* of a neighboring feed system 5.

In the invention, the feed system 5 also has a damping channel 54 that extends the first portion 51*a* of the feed channel 51 at the junction 52. The damping channel 54 opens out at a first end 54*a* (FIG. 2B) into the junction 52, and it is blind or obstructed at a second end 54*b*. In the example shown, the damping channel 54 presents a semicircular section of radius R having a flat portion that rests on the base plate 10. In order to conserve a constant section between the feed channel and the damping channel, the radius R may be such that $R=(d/2)\sqrt{2}$.

The damping channel 54 extends in a direction C that is horizontal in this example. The directions A, B, and C of the portions 51*a*, 51*b*, and of the channel 54 are directions that extend in the immediate proximity of the junction 52. In this example, the projections of the directions A and C onto the base plate 10 coincide, and the directions B and C are mutually orthogonal at the junction 52.

It should be observed that the fact that the damping channel 54 extends the first portion 51*a* of the feed channel 51 does not necessarily mean that the directions A and C are identical. Extending the first portion 51*a* by means of the damping channel 54 enables the first stream of molten metal to go towards the damping channel 54 on penetrating into the feed system 5.

The path followed by a liquid metal inside the installation 1 is represented diagrammatically by continuous arrows in FIG. 2A.

Figure 3:
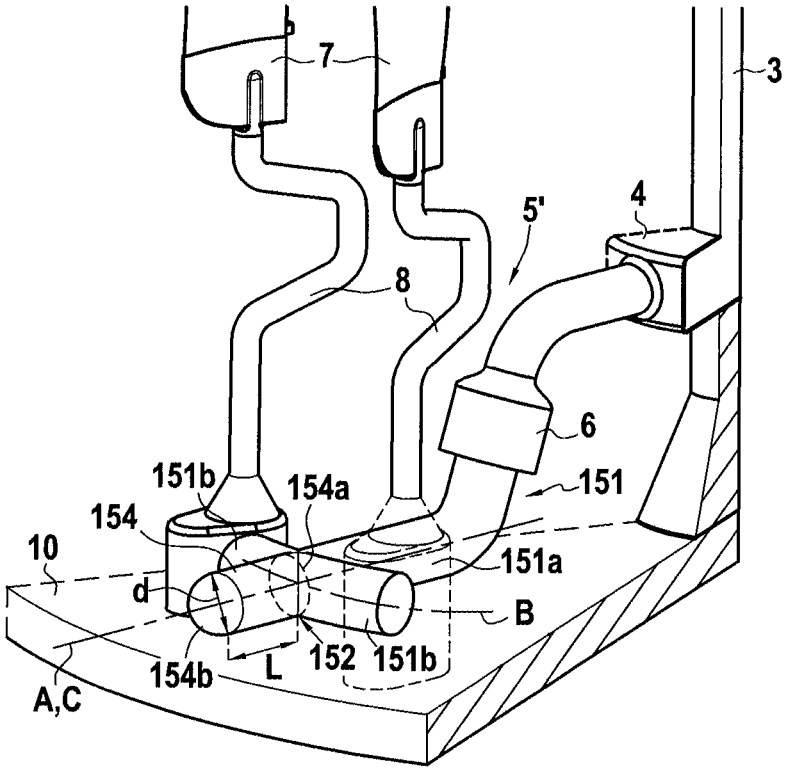
FIGS. 3 and 4 show other examples of feed systems of the invention.

FIG. 3 shows a feed system 5' in another embodiment of the invention. As above, the feed system 5' comprises a feed channel 151 provided with a first portion 151*a* extended downstream by a damping channel 154 and by two second portions 151*b*. The first portion 151*a* and the two second portions 151*b* meet at a junction 152. The damping channel 154 also opens out at its first end 154*a* into the junction 152 and it is blind or closed at its second end 154*b*. In this example, the feed channel 151 and the damping channel 154 are not supported by the base plate 10, and each of them presents a circular section of diameter d. The first portion 151*a* of the feed channel 151 extends in a first direction A that is horizontal, and the damping channel 154 extends in a direction C that coincides with the direction A. The two second portions 151*b* of the feed channel 151 extend on either side of the junction 152 in a second direction B that is horizontal and orthogonal to the direction A at the junction 152. In this example, the length L of the damping channel 154 may be equal to at least twice the diameter d of the damping channel 154, thus making it possible to conserve a constant section between the damping channel 154 and the feed channel 151.

Figure 4:
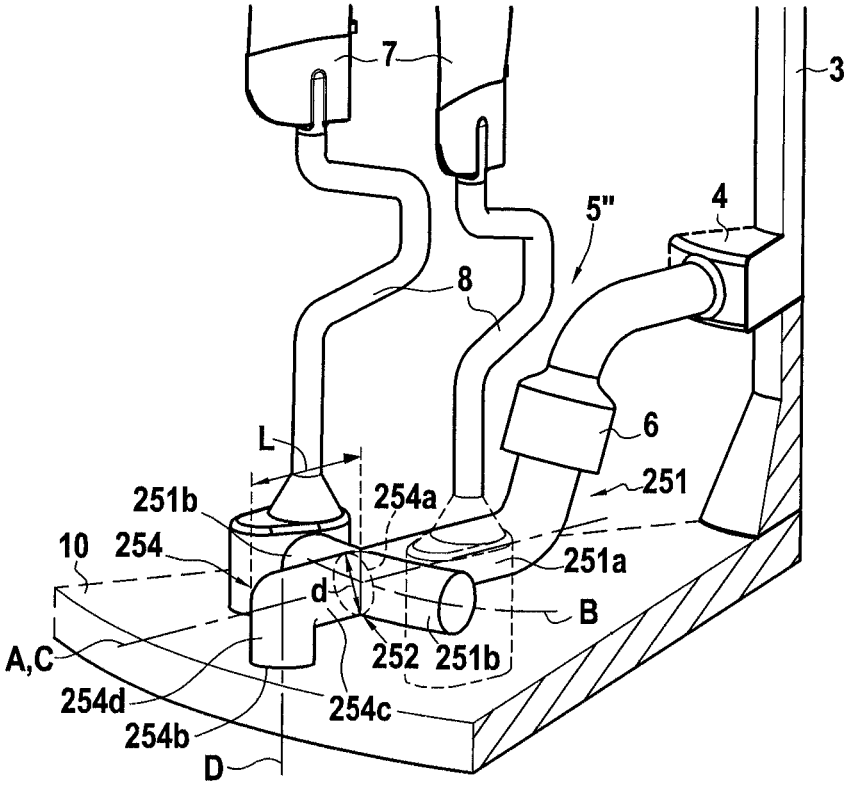

FIG. 4 shows a feed system 5" in yet another embodiment of the invention. As above, the feed system 5" comprises a feed channel 251 provided with a first portion 251*a* extended downstream by a damping channel 254 and by two second portions 251*b*. The first portion 251*a* and the two second portions 251*b* meet at a junction 252. The damping channel 254 also opens out at its first end 254*a* into the junction 252 and it is blind at its second end 254*b*. The two second portions 251*b* of the feed channel 251 extend on either side of the junction 252 in a second direction B that is horizontal and orthogonal to the direction A at the junction 252.

In this example, the damping channel 254 has two portions 254*c* and 254*d*, whereas each of the above-described channels 54 and 154 has a single portion. The first portion 254*c* extends between the first end 254*a* and the second portion 254*d*; the second portion 254*d* extends between the first portion 254*c* and the second end 254*d* of the damping channel 254. The first portion 254*c* of the damping channel 254 extends in a first direction A that is horizontal, and the first portion 251*a* of the feed channel 251 extends in a direction C that coincides in this example with the direction A. The second portion 254*d* of the damping channel 254 extends in a direction D that is vertical in this example so that the second portion 254*d* is lower than the first portion 254*c*. This arrangement serves to further increase the effect of trapping the first metal stream by gravity. In this example, the second end 254*b* of the damping channel 254 is level with the base plate 10 so that the damping channel 254 rests on the base plate 10. It should be observed that the direction D need not be vertical and could merely be inclined, nevertheless, the effect of trapping the first metal stream is maximized when using a vertical direction. In this example, the feed and damping channels 251 and 254 are circular in section with the diameter d. The length L of the first portion 254*c* of the damping channel 254 may be greater than or equal to twice the diameter d.

It should be observed that in all of the above examples, the feed channel 51, 151, 251 has two second portions 51*b*, 151*b*, 251*b*, but it could have only one, or indeed it could have more than two.

The installation 1 as described above can be made entirely out of ceramic material, e.g. by a lost wax casting method. In known manner, a wax model of the installation 1 needs to be made initially. Thereafter, the wax model is covered in a ceramic shell by being dipped successively into an appropriate slurry (dipping/application of stucco). Thereafter, the ceramic is fired and the wax is removed in order to obtain the installation 1 made of ceramic material.

Figure 5:
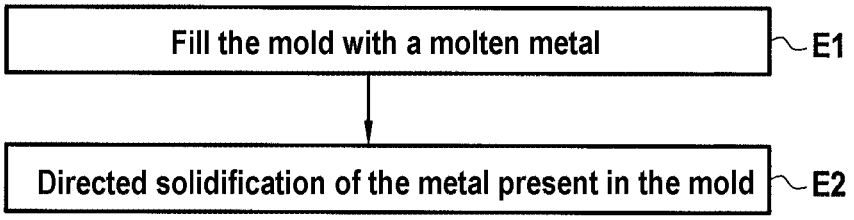
FIG. 5 is a flow chart showing the main steps of a method of fabricating a casting by using an installation of the invention.

FIG. 5 shows the main steps of a method of fabricating a casting from a molten metal by using an installation 1 as described above. The first step E1 of the method consists in filling the mold 7 of the installation 1 by pouring a molten metal into the installation. To do this, it is possible to pour the metal directly into the bush 2 of the installation 1, and the metal can then be conveyed by gravity until it fills the mold 7.

The second step E2 consists in implementing directed solidification of the metal present in the mold so as to obtain the casting. Directed solidification is performed in an appropriate oven in which the installation is placed. The oven serves to control the growth of crystal grains e.g. so as to obtain parts that are monocrystalline. Once the part has solidified, it can be knocked out and subjected to finishing machining.

The invention claimed is:

1. An installation made of ceramic material for fabricating a plurality of castings from a molten metal, the installation comprising:

a vertical duct surmounted by a bush through which a liquid metal is to be introduced into the installation, the vertical duct including a distributor in proximity of its bottom end;

at least one feed system for conveying the molten metal for making the castings, each feed system comprising a feed channel configured to enable the molten metal to flow under gravity inside said feed channel, said feed channel having a first portion extending in a first direction from the distributor, and two second portions extending in a second direction different from the first direction, each second portion being arranged downstream from the first portion and being connected to the first portion by a junction; and at least two molds, each mold being connected to a second portion of the feed channel so as to convey a molten metal from the feed system into each mold;

wherein the feed system further comprises a damping channel having a first end opening out into the junction and a second end that is closed, said damping channel extending the first portion of the feed channel.

2. An installation according to claim 1, wherein the feed channel of the feed system presents a section that is circular, the length of the damping channel being greater than or equal to twice the diameter of the feed channel.

3. An installation according to claim 1, wherein the damping channel has a first portion extending between the first end and a second portion, said second portion extending between said first portion and said second end of the damping channel, said second portion being situated lower than said first portion.

4. An installation according to claim 3, wherein the second portion of the damping channel of the feed system extends in an inclined direction.

5. An installation according to claim 3, wherein the second portion of the damping channel of the feed system extends in a vertical direction.

6. An installation according to claim 1, wherein the damping channel of the feed system presents a section that is semicircular.

7. An installation according to claim 1, wherein the first and second directions are mutually orthogonal.

8. An installation according to claim 1, further comprising at least two grain selector ducts, each grain selector duct being connected both to a second portion of a feed channel and also to a mold.

9. An installation according to claim 1, wherein the molds are adapted to mold turbine blades of an aviation turbine engine.

10. A method of fabricating a plurality of castings from a molten metal, the method comprising:

filling molds with a molten metal by introducing the molten metal into the bush of an installation according to claim 1; and implementing directed solidification of the molten metal present in each mold so as to obtain the casting.

* * * * *